United States Patent [19]

Ball

[11] Patent Number: 5,067,411

[45] Date of Patent: Nov. 26, 1991

[54] WEAPON SYSTEMS

[75] Inventor: Richard F. Ball, Bristol, United Kingdom

[73] Assignee: British Aerospace PLC, London, England

[21] Appl. No.: 562,955

[22] Filed: Aug. 6, 1990

[30] Foreign Application Priority Data

Aug. 10, 1989 [GB] United Kingdom ..... 8982679

[51] Int. Cl.[5] ..... F42B 12/58; F41G 7/00

[52] U.S. Cl. ..... 102/489; 244/3.1; 244/3.11; 244/3.14

[58] Field of Search ..... 102/489; 244/3.1, 3.11, 244/3.14

[56] References Cited

U.S. PATENT DOCUMENTS

| | | | |
|---|---|---|---|
| 4,444,117 | 4/1984 | Mitchell, Jr. | 102/489 |
| 4,455,943 | 6/1984 | Pinson | 102/489 |
| 4,516,502 | 3/1985 | Klein et al. | 102/489 |
| 4,553,718 | 11/1985 | Pinson | 244/3.15 |
| 4,770,101 | 9/1988 | Robertson et al. | 102/489 |
| 4,907,512 | 3/1990 | Arene | 102/489 |

FOREIGN PATENT DOCUMENTS

| | | | |
|---|---|---|---|
| 0048067 | 9/1981 | European Pat. Off. . | |
| 0048068 | 9/1981 | European Pat. Off. . | |
| 0114901 | 8/1984 | European Pat. Off. . | |
| 0255214 | 6/1987 | European Pat. Off. . | |
| 0277445 | 12/1987 | European Pat. Off. . | |
| 1815822 | 10/1972 | Fed. Rep. of Germany . | |
| 2364195 | 6/1975 | Fed. Rep. of Germany . | |
| 2280877 | 2/1976 | France | 102/489 |

*Primary Examiner*—Harold J. Tudor

*Attorney, Agent, or Firm*—Nixon & Vanderhye

[57] ABSTRACT

A weapon system including a primary weapon arranged to be guided to a target, and further comprising at least one secondary weapon forming a unit with the primary weapon, but being releasable from the primary weapon on the approach to a target, the secondary weapon or weapons being controllable, on release, to ensure target destruction should the primary weapon not succeed in target destruction.

5 Claims, 2 Drawing Sheets

WEAPON SYSTEMS

BACKGROUND OF THE INVENTION

1. Field of the Invention

This invention relates to guided weapon systems.

2. Discussion of Prior Art

Hitherto guided weapons have been guided towards a target and have either impacted with it or detonated near it to cause destruction. However, if for what ever reason neither action results in destruction the mission has failed and a further weapon or wave of weapons must be launched at great expense and doubtful efficiency. Moreover any delay in such launch will lessen the likelihood of a kill success.

SUMMARY OF THE INVENTION

The present invention therefore has for an objective the provision of a weapon system which can effect destruction of a target even if the prime weapon does not do so.

According to the present invention there is provided a weapon system including a primary weapon arranged to be guided to a target, and further comprising at least one secondary weapon forming a unit with the primary weapon, but being releasable from the primary weapon on the approach to a target, the secondary weapon or weapons being controllable, on release, to ensure target destruction should the primary weapon not succeed in target destruction.

Preferably the control of the secondary weapon or weapons is effected using information gathered by the primary weapon.

Preferably the control on release of the or each secondary weapon includes not only course correction but retardation with respect to the primary vehicle.

Preferably the or each secondary weapon are housed with primary weapon prior to release.

BRIEF DESCRIPTION OF THE DRAWINGS

Reference will now be made, by way of example, to the accompanying drawings, in which.

DETAILED DISCUSSION OF PREFERRED EMBODIMENTS

Figure 1:
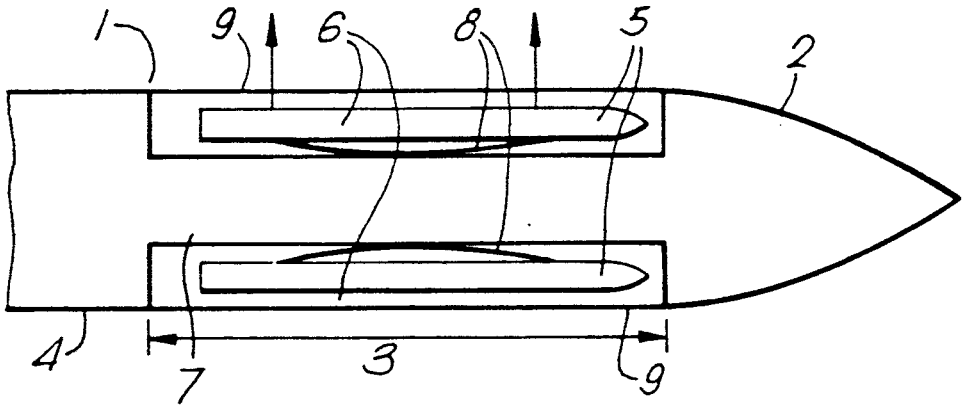
FIG. 1 is a cross-sectional diagram of the front part of a weapon system according to a first and second embodiment of the present invention.

In FIG. 1 a weapon unit shown generally at 1 includes a primary weapon 2 and a number of secondary weapons (of which 2 are shown) 5 which are held in a circumferential recess 6 in the primary weapon body. As a consequence the section 7 of the body is of smaller diameter than the rest of the primary weapon body. Springs 8 (for example leaf springs) are located between section 7 and secondary weapons 5. During normal flight of the primary weapon the springs are held compressed by covers 9 which encase recess 6, and press the secondary weapons towards section 7 of the primary weapon body. At a predetermined time during the flight of the weapon, the covers 9 are removed, in any known way, and the secondary weapons are deployed from of the recess, so that they remain substantially parallel to the axis of the primary weapon.

This could be achieved by aerodynamic means alone or as is mentioned above by a pre-set mechanism, such as a spring. The spring has the advantage, that due to the fact that the side impulse is pre-set, the secondary weapons will fly a path parallel to that of the primary weapon, but offset by a known amount.

The secondary weapons are designed to have a greater relative aerodynamic drag than the primary weapon. As a result the secondary weapons start to lag behind as flight of the primary weapon continues.

The primary weapon may be guided towards a target by a suitable homing device, however in one embodiment of the invention it is anticipated that course correction will be complete by the time the secondary weapons are deployed, i.e. there is no subsequent manoeuvring of the primary weapon. In another embodiment the secondary weapons may be slaved to the primary weapon so that the primary weapon can be manoeuvred after separation and the secondary weapons follow. This would be the preferred embodiment since separation could occur earlier than in the non-slaved embodiment thereby making timing of the separation less critical. Another preference for the slaving embodiment is that manoeuvring of the primary weapon can be continued up to a shorter range.

Figure 4:
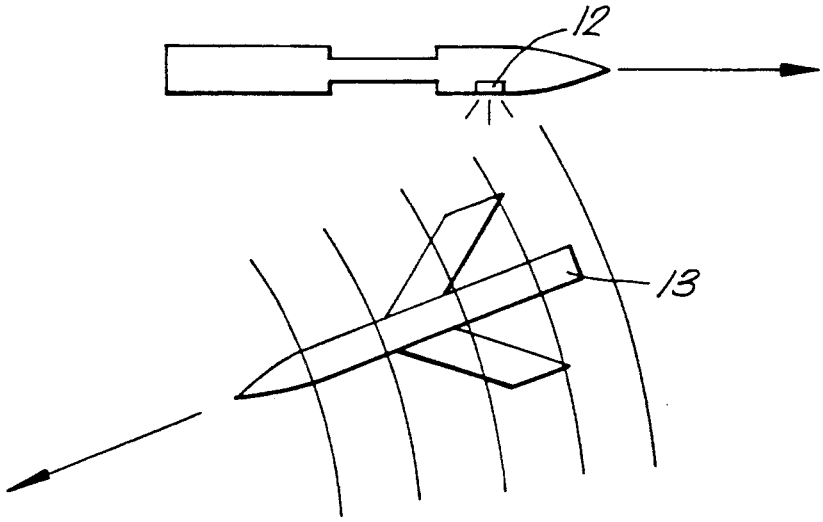

In either of the above mentioned embodiments, at a certain point the primary weapon should be 'on target' and about to impact the target. If the primary weapon does impact the target the aims of the mission will be achieved and no further action will be taken. However, if the primary weapon for some reason or another misses the target further action is taken. The primary weapon is equipped with a sensor 12 (as shown in FIG. 4) which views the target 13 as it passes, and measures the relative geometry in terms of "miss-distance" in 2-dimensions and "time of interception" as the third. The sensor could be common with those used to home, but are much more likely to be specifically designed for the purposes described.

Figure 3:
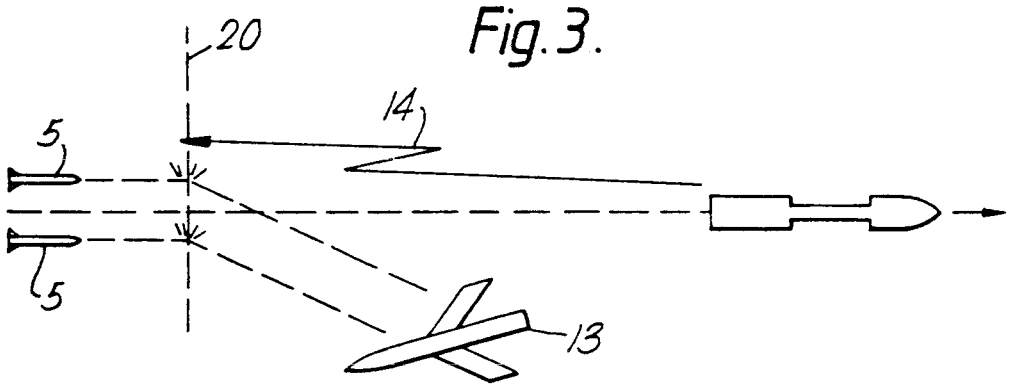
FIGS. 3 and 4 are diagrams for illustrating the functioning of the embodiments of the invention.

The sensor will operate only as the primary weapon passes the target and may use time-dependent signal processing techniques. The sensor will then calculate any required course correction to ensure the secondary weapons 5 (as shown in FIG. 3) impact the target. A signal command broadcast 14 is then transmitted to the secondary weapons so that they may effect any required course correction, for example at a predetermined point, say 20.

This course correction may be achieved in any known manner, for example by means of a circumferentially placed thruster unit II. The position in roll of each secondary weapon being referenced to ensure correct course correction. This time lag between the primary and the secondary weapons in sufficiently large to allow for the calculation time and the reaction times of the two weapons of the system. The offset between the primary and secondary weapons may be compensated in the course-correction command. Each secondary weapon may calculate its own correction based on a common, broadcast command from the primary weapon.

Figure 2:
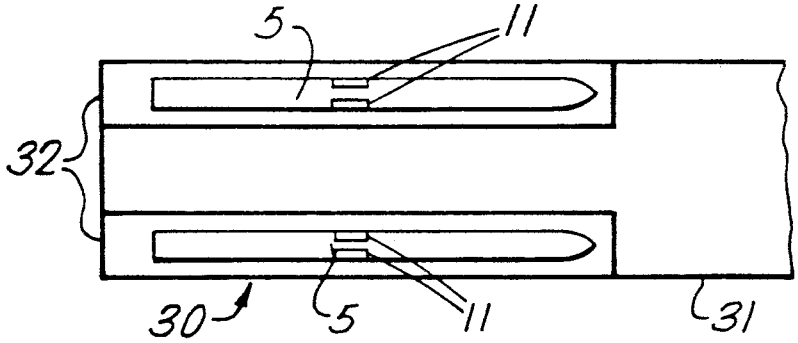
FIG. 2 is a cross-section diagram of the rear part of a weapon system according to a third embodiment of the present invention.

In FIG. 2 another embodiment of the invention is shown. In this case the secondary weapons 5 are located in the rear section 30 of the primary weapon 31. At the appropriate time the secondary weapons slide out of the back of the primary weapon via ports 32. The initiation of the deployment may be activated by springs (not shown) as in the previous embodiments, or merely by gravity as a result of say the flight path of the primary weapon being somewhat upwards, or in any other way, for example, by virtue of the greater relative aerodynamic drag of the secondary weapons.

It should be noted that the secondary weapon may be located anywhere within the primary weapon. For example the secondary weapons may be deployed from inside the primary weapon one at a time so that they are not offset from the carrier as is shown in FIG. 3. The secondary weapons may alternatively be attached to the outside of the primary weapon or towed behind the primary weapon.

Any number of secondary weapons may be deployed from a single primary weapon the number being dependant upon space and weight consideration.

The leaf spring may be replaced by a number of springs of any different type.

The deployment of the secondary weapons can be effected at anytime during the flight but at the latest will probably be about half a second from interception.

I claim:

1. A weapon system for at least damaging a target, said system comprising:

a primary weapon; and at least one secondary weapon carried by said primary weapon; said primary weapon including:

means for releasing said at least one secondary weapon from said primary weapon;

homing means for guiding said primary weapon towards said target;

sensor means for detecting any target miss-distance; and transmitter means for transmitting data generated by said sensor means to said at least one secondary weapon; said at least one secondary weapon including:

receiving means for receiving said data transmitted from said primary weapon; and means for altering course of said at least one secondary weapon relative to said primary weapon in response to said received data in order to damage said target.

2. A weapon system according to claim 1, wherein said at least one secondary weapon comprises a plurality of secondary weapons, said primary weapon includes a circumferential recess for accommodating said plurality of secondary weapons, wherein said means for releasing comprises at least one leaf spring.

3. A weapon system according to claim 1, wherein said secondary weapon is stowed in a rear section of said primary weapon.

4. A weapon system according to claim 1, wherein said means for altering course includes means for increasing aerodynamic drag on said secondary weapon to be greater than aerodynamic drag on said primary weapon.

5. A weapon system according to claim 1, wherein said means for altering course comprises a thruster unit.

* * * * *